US006039605A

United States Patent [19]

Tanaka

[11] Patent Number: 6,039,605

[45] Date of Patent: Mar. 21, 2000

[54] SHIELD CONNECTOR WITH ENHANCED INSULATION OF A SHIELD SHELL

[75] Inventor: Tsutomu Tanaka, Nagoya, Japan

[73] Assignees: Harness Systems Technologies Research, Ltd., Nagoya; Sumitomo Wiring Systems, Ltd., Mie; Sumitomo Electric Industries, Ltd., Osaka, all of Japan

[21] Appl. No.: 09/110,267

[22] Filed: Jul. 6, 1998

[30] Foreign Application Priority Data

Jul. 22, 1997 [JP] Japan ..... 9-196130

[51] Int. Cl.[7] ..... H01R 9/03

[52] U.S. Cl. ..... 439/610; 439/675

[58] Field of Search ..... 439/610; 77/578, 77/675

[56] References Cited

U.S. PATENT DOCUMENTS

| | | | |
|---|---|---|---|
| 5,281,170 | 1/1994 | Murphy | 439/610 |
| 5,618,190 | 4/1997 | Masuda et al. | 439/98 |
| 5,645,450 | 7/1997 | Yamada et al. | 439/585 |
| 5,672,076 | 9/1997 | Inaba et al. | 439/610 |
| 5,703,324 | 12/1997 | Harder | 174/21 C |
| 5,725,391 | 3/1998 | Masuda et al. | 439/582 |
| 5,823,824 | 10/1998 | Mitamura et al. | 439/585 |
| 5,904,595 | 5/1999 | Tamigawa | 439/610 |
| 5,951,327 | 9/1999 | Marik | 439/610 |

*Primary Examiner*—Khiem Nguyen
*Assistant Examiner*—Michael C. Zarroli
*Attorney, Agent, or Firm*—Oliff & Berridge, PLC

[57] ABSTRACT

A shield connector includes a female connector housing and a male connector housing. The female connector housing has an axially-extending retainer disposed within the female connector housing and has a radially-extending female-side fitting surface disposed forward of the retainer with a hole formed therethrough. The male connector housing includes a step portion, a male-side fitting surface and a male metal terminal that is mounted in the male connector housing. The male metal terminal has a distal end portion that projects axially from the male-side fitting surface. The step portion is disposed within the male connector housing and has a radially-extending inner peripheral surface that intersects the male-side fitting surface to define a receiving chamber. The male and female connector housings are sized and adapted for releasable connection with each other such that the receiving chamber slidably and releasably receives at least a portion of the retainer in a close-fitting relationship while the distal end portion is inserted through the hole with the male-side fitting surface and the female-side fitting surface being positioned in facial registration with each other.

5 Claims, 4 Drawing Sheets

SHIELD CONNECTOR WITH ENHANCED INSULATION OF A SHIELD SHELL

BACKGROUND OF THE INVENTION

1. Field of the Invention

This invention relates to a shield connector.

2. Description of Related Art

A conventional shield connector includes a pair of female and male connector housings which can be fitted together, a pair of female and male metal terminals mounted respectively in the two housings, and shield shells which are mounted respectively in the two connector housings in surrounding relation to the metal terminals, respectively. A distal end portion (hereinafter referred to as "tab") of the male metal terminals projects from a fitting surface of the male connector housing provided at a front end thereof. The shield shell projects forwardly beyond the fitting surface. When the two connector housings are fitted together, the tab projects into the female connector housing, and is connected to the female metal terminal. Also, the projected shield shell is connected to the mating shield shell in overlapping relation thereto, so that the connected portions of the two metal terminals are shielded by these shield shells.

In the above conventional shield connector, a small gap is inevitably formed between the fitting surfaces of the two connector housings, and therefore the tab is exposed to the shield shell through this gap. As a result, when a voltage is applied, there is a possibility that an electrostatic discharge is produced between the tab and the shield shell along the fitting surfaces.

SUMMARY OF THE INVENTION

The present invention has been made in view of the above problem, and an object of the invention is to provide a structure in which the insulation of a distal end portion of a male metal terminal from a shield shell is enhanced.

A shield connector of the invention includes a pair of female and male connector housings fitted together, with their fitting surfaces abutted against each other, a male metal terminal which is mounted in the male connector housing and has a distal end portion projecting from the fitting surface of the male connector housing, and a shield shell disposed in a direction to intersect the fitting surfaces when the two connector housings are fitted together. A step portion is formed on one of the two connector housings and is exposed to the distal end portion of the male metal terminal through a gap between the fitting surfaces when the two connector housings are fitted together. The shield shell passes through the step portion.

It is preferred that the fitting surface of the one connector housing is disposed axially inwardly of the step portion.

It is also preferred that a hood portion is formed on the one connector housing, and projects forwardly from an outer peripheral edge of the fitting surface of the one connector housing. The step portion projects inwardly from an inner periphery of the hood portion along the fitting surface.

BRIEF DESCRIPTION OF THE DRAWINGS

Other features of the invention will become apparent as the following description proceeds and upon reference to the drawings, in which.

DETAILED DESCRIPTION OF PREFERRED EMBODIMENTS

A preferred embodiment of the invention will now be described with reference to FIGS. 1 to 3.

A shield connector 8 (FIG. 3) of this embodiment of the invention includes a female housing connector 10F and a male connector housings 10M, a female metal terminal 20F, a male metal terminal 20M received respectively in the male and female connector housings 10M and 10F, a pair of shield wire end portions 30 of a shield wire connected respectively to the male and female metal terminals 20M and 20F, a male-side shield shell 40M and a female-side shield shell 40F fixedly secured respective ones the shield wire end portions 30.

The male connector housing 10M has a double-wall tubular structure and includes a male inner cylindrical tubular portion 11M and a male outer cylindrical tubular portion 12M which are integrally connected together in a concentric manner by a connecting portion 13M at a front end of the inner tubular portion 11M, and a front end portion of the outer tubular portion 12M defines a hood portion 14M projecting forwardly beyond the inner tubular portion 11M.

The male metal terminal 20M is inserted in a cavity 15M in the inner tubular portion 11M, and is retained by a lance 16M against withdrawal. A tab 21M, which is a distal end portion of the male metal terminal 20M, projects forwardly from a fitting surface 17M defined by a front surface of the inner tubular portion 11M. An end portion of a conductor 30A of the shield wire end portion 30 is compressively secured to a rear end portion of the male metal terminal 20M. A sheath 30C of the shield wire end portion 30 is removed at an end portion thereof to thereby expose an end portion of a shield layer 30B, and an end portion of the sheath 30C is fixedly secured to a rear end of the outer tubular portion 12M by a waterproof plug 31M.

Figure 1:
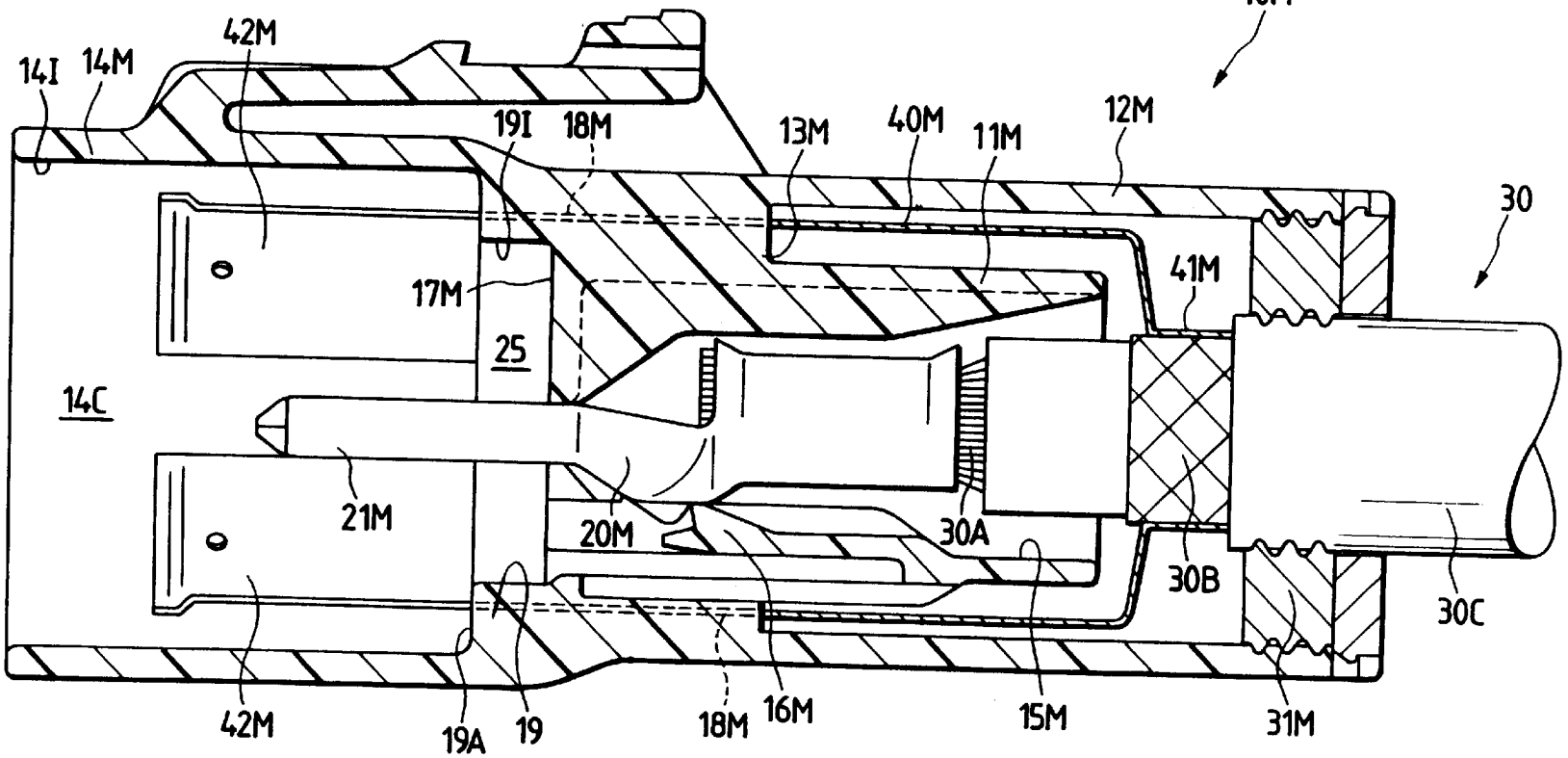
FIG. 1 is a cross-sectional view of a male connector housing, a component of a first embodiment of a shield connector of the present invention.

With reference to FIG. 1, the male-side shield shell 40M is disposed between the inner tubular portion 11M and the outer tubular portion 12M, and the male-side shield shell 40M shields that portion of a conductive path (formed by the conductor 30A of the shield wire end portion 30 and the female and male metal terminals 20F and 20M when fitted together) which is not shielded by the shield layer 30B. The male-side shield shell 40M includes an electrically-conductive, thin sheet, and is connected at its rear end which defines a barrel portion 41M to the exposed portion of the shield layer 30B. A front half portion of the male-side shield shell 40M is circumferentially divided into four sections 42M, and the male-side shield shell 40M is mounted on the male connector housing 10M by passing these four sections 42M respectively through arcuate slits 18M formed through the connecting portion 13M. In this mounted condition, the sections 42M of the male-side shield shell 40M project forwardly beyond the inner tubular portion 11M and the connecting portion 13M, and can be resiliently bent radially of the shield shell 40M, and are adapted to resiliently contact an outer peripheral surface of the female-side shield shell 40F in overlapping relation thereto as described later.

In the male connector housing 10M, an annular step portion 19 is formed at a boundary between an outer peripheral edge of the fitting surface 17M and an inner periphery surface 14I of an inner end of the hood portion 14M that defines a hood chamber 14C. The step portion 19 serves as a mechanism for preventing an electrostatic discharge from developing between the tab 21M and the sections 42M. The step portion 19 extends forwardly from the connecting portion 13M and the fitting surface 17M is disposed axially inwardly of a front surface 19A of the step portion 19. In other words, the step portion 19 projects radially inwardly along an inner peripheral surface 19I from the inner periphery surface 14I of the inner end of the hood portion 14M to the fitting surface 17M. The inner peripheral surface 19I and the fitting surface 17M define a receiving chamber 25. The sections 42M of the male-side shield shell 40M passes through the step portion 19 and projects from the front surface 19A of the step portion 19.

Figure 2:
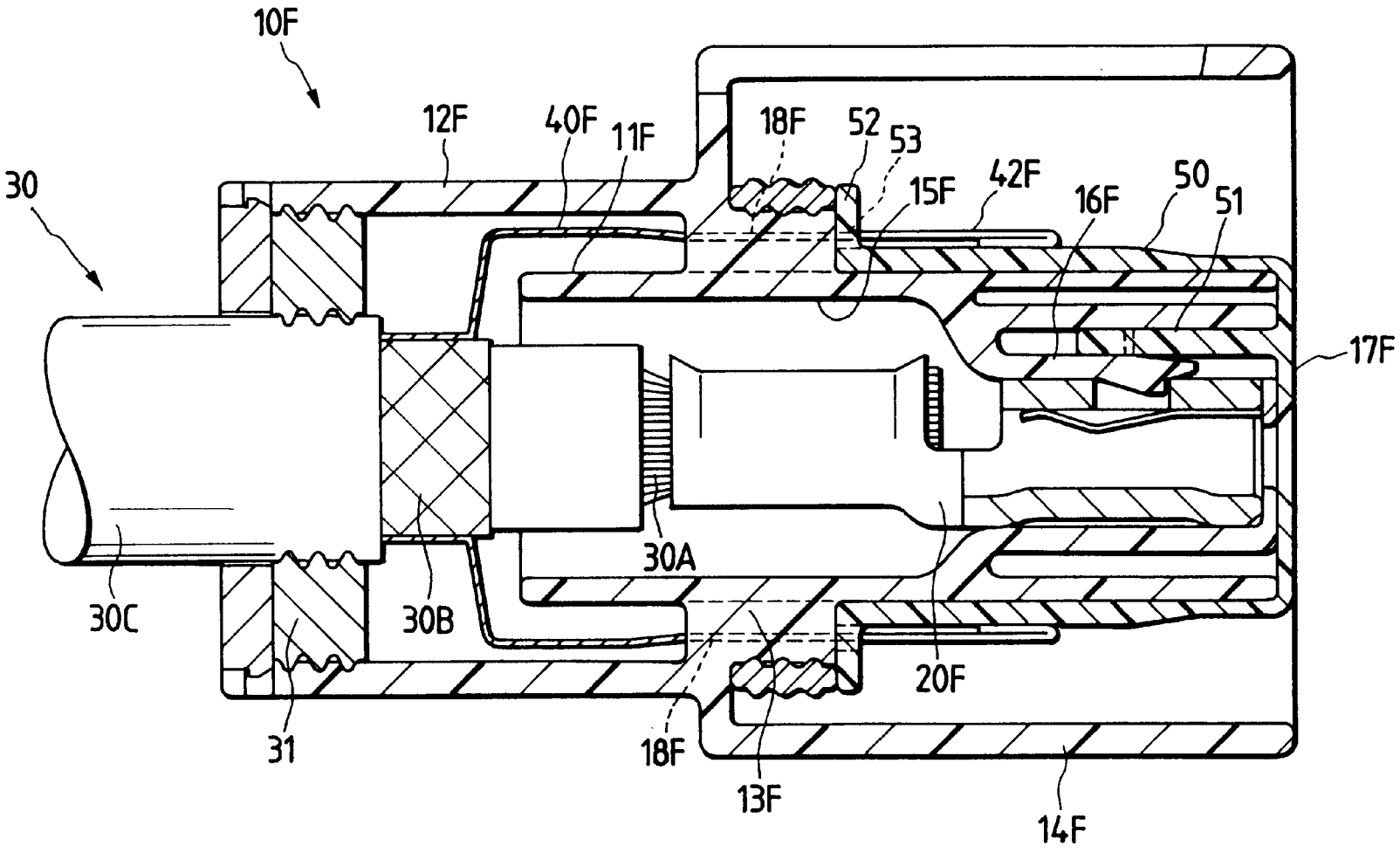
FIG. 2 is a cross-sectional view of a female connector housing, a complementary component of the first embodiment of the shield connector of the present invention.
Figure 3:
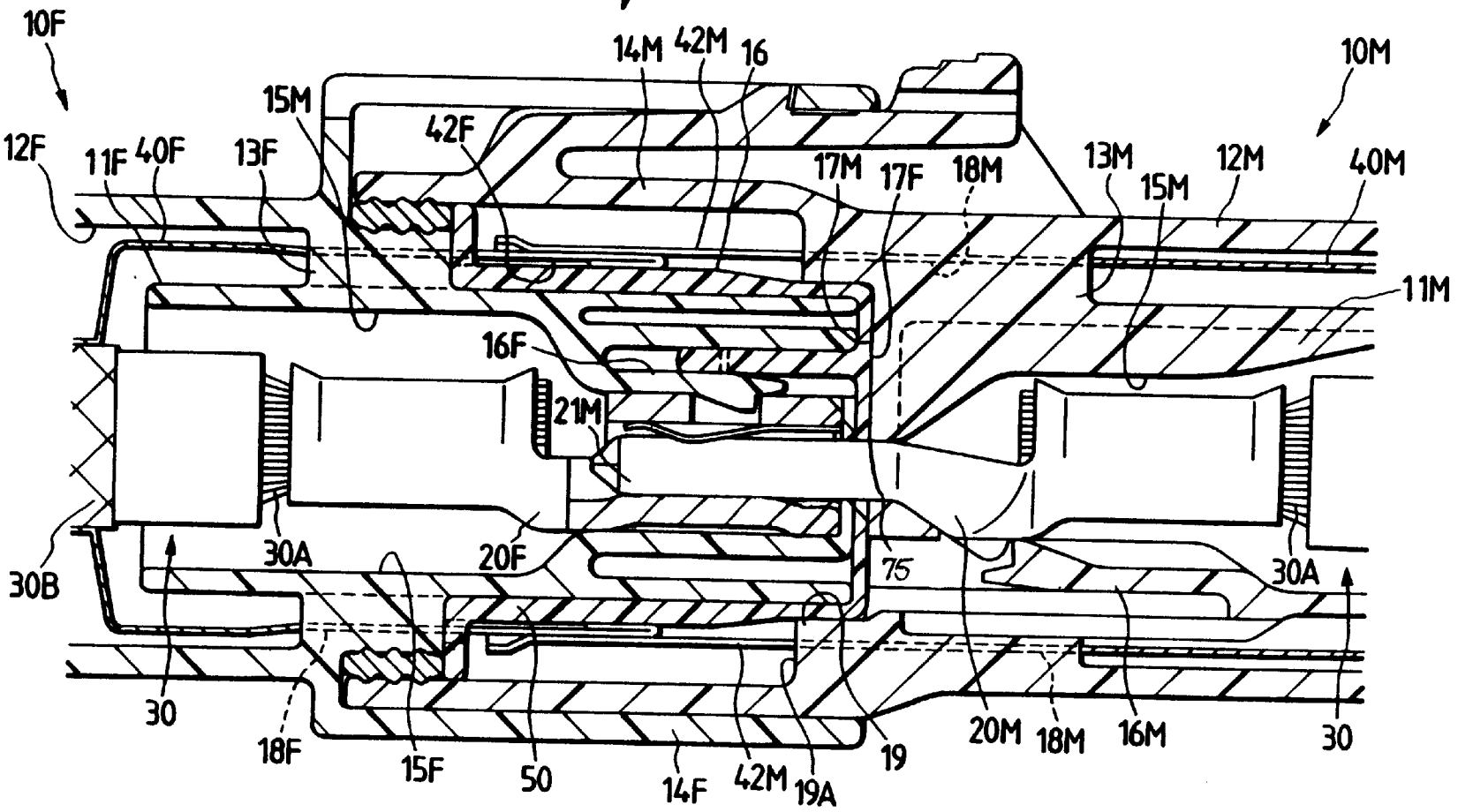
FIG. 3 is a fragmentary cross-sectional view showing the male and female connector housings fitted together.
Figure 4:
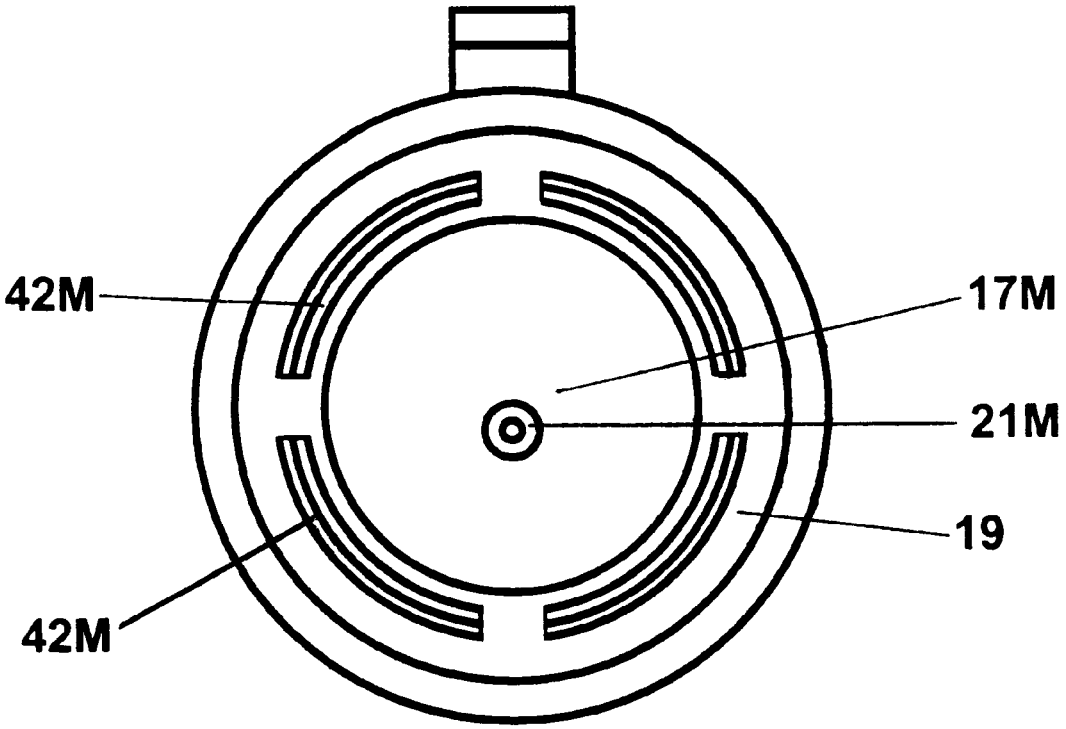
FIG. 4 is a frontal view of the male connector showen in FIG. 1.

Like the male connector housing 10M, the female connector housing 10F has a double-wall tubular construction, and includes an inner cylindrical tubular portion 11F and an outer cylindrical tubular portion 12F which are integrally connected together in a concentric manner by a connecting portion 13F as best shown in FIG. 2. A front end portion of the inner tubular portion 11F is sized to be fitted in the receiving chamber 25 of the male connector housing 10M. The female metal terminal 20F is inserted in a cavity 15F in the inner tubular portion 11F, and is retained by a lance 16F against withdrawal. A conductor 30A of the shield wire 30 is compressively secured to a rear end portion of the female metal terminal 20F, and an end portion of a sheath 30C of the shield wire 30 is fixedly secured to a rear end of the outer tubular portion 12F by a waterproof plug 31F. The outer tubular portion 12F is stepped such that its front end portion is formed into a fitting portion 14F of a larger diameter, and this fitting portion 14F is adapted to fit on the hood portion 14M of the male connector housing 10M.

With reference to FIG. 2, the female-side shield shell 40F is disposed between a female inner tubular portion 11F and a female outer tubular portion 12F. The female shield shell 40F shields that portion of a conductive path (formed by the conductor 30A of the shield wire 30 and the female and male metal terminals 20F and 20M when fitted together) which is not shielded by the shield layer 30B. Like the male-side shield shell 40M, the female-side shielded shell 40F includes an electrically-conductive, thin sheet, and its front half portion is circumferentially divided into four sections 42F, and the female-side shield shell 40F is mounted on the female connector housing 10F by passing these four sections 42F respectively through arcuate slits 18F formed through a connecting portion 13F. In this mounted condition, the sections 42F are adapted to contact respective inner surfaces of the sections 42M of the male-side shield shell 40M.

A retainer 50 (which is the front end portion of the inner tubular portion (1F) is fitted on the inner cylindrical tubular portion 11F of the female connector housing 10F from a front side thereof, and a limitation piece portion 51 of the retainer 50 engages a lance 16F to prevent the lance 16F from being displaced in a direction to release this engagement, thus achieving double retaining of the female metal terminal 20F. Arcuate grooves 53, aligned respectively with slits 18F, are formed through a flange 52 formed at a rear end of the retainer 50, and the sections 42F pass respectively through the through grooves 53 and extend over an outer peripheral surface of the retainer 50. A front side of the retainer 50 serves as a fitting surface 17F of the female connector housing 10F.

Next, the operation of this embodiment will be described.

When the two connector housings 10M and 10F are fitted together, a fitting portion 14F is fitted on the hood portion 14M and also the female-side inner tubular portion 11F is fitted in the male-side step portion 19, so that the fitting surfaces 17M and 17F of the two connector housings are opposed to each other, with a very small gap formed therebetween. The tab 21M passes through the female-side fitting surface 17F, and is connected to the female metal terminal 20F. The sections 42M of the male-side shield shell 40M contact the outer surfaces of the sections 42F of the female-side shield shell 40F in overlapping relation.

In this fitted condition, with respect to the relation between the tab 21M and the male-side shield shell 40M, the exposed portion of the tab 21M is present in a gap 75 between the fitting surfaces 17M and 17F whereas the sections 42M of the male-side shield shell 40M are exposed from the front surface 19A of the step portion 19 disposed forwardly of the fitting surface 17M, and therefore the tab 21M is not directly exposed to the male-side shield shell 40M. Namely, the tab 21M is exposed to the inner peripheral surface of the step portion 19, and the sections 42M are exposed to an outer peripheral surface 76 of the retainer 50. In this embodiment, a creeping distance between the tab 21M and the male-side shield shell 40M is longer by an amount corresponding to the dimension of the step of the step portion 19 relative to the fitting surface 17M, as compared with a structure in which a tab is directly exposed to a shield shell through a gap between fitting surfaces, and with the structure of this embodiment, the generation of a discharge is prevented.

In the fitted condition, the distal end portion of the male metal terminal is not directly exposed to the shield shell through the gap between the fitting surfaces, but is exposed to the inner surface of the step portion. Namely, the creeping distance between the shield shell and the distal end portion of the male metal terminal is longer by an amount corresponding to the dimension of the step portion, as compared with a construction in which a shield shell is directly exposed to a distal end portion of a male metal terminal through a gap between fitting surfaces, and therefore the generation of a discharge is prevented.

The present invention is not limited to the above embodiment described above and shown in the drawings. For example, the following embodiments fall within the scope of the present invention and, furthermore, other various modifications than the following can be made without departing from the scope of the invention.

In the above embodiment, when the two connector housings are fitted together, only the shield shell of the male connector housing is disposed in a direction to intersect the fitting surfaces. However, the present invention can be applied to the case where only the female-side shield shell or both of the male-side and female-side shield shells may be so arranged as to be disposed in a direction to intersect the fitting surfaces.

In the above embodiment, although the step portion is formed at the peripheral edge of the fitting surface, the step portion may be formed radially inwardly of the peripheral edge of the fitting surface.

In the above embodiment, although the step portion projects forwardly from the fitting surface, the step portion may project from an inner periphery of the hood portion in spaced relation to the fitting surface.

In the above embodiment, the step portion is formed over the entire circumference. However, if the shield shell is not provided over the entire circumference, the step portion may be provided only at those regions corresponding to such shield shell.

In the above embodiment, although the step portion is formed at the male connector housing, a step portion may project from the fitting surface of the female connector housing, in which case the distal end portion of the shield shell of the male connector housing is fitted in the step portion of the female connector housing.

In the above embodiment, although the distal end portion of the male metal terminal is formed into the tab in the form of a flat plate, the present invention can be applied to the case where the distal end portion of the male metal terminal has other shapes such as a tubular shape and cylindrical shape.

In the above embodiment, although each shield shell is fixedly secured to the shield wire, the present invention can be applied to the case where the shield shell is not fixedly secured to the shield wire.

In the above embodiment, although the distal end portion of each shield shell is divided into four sections, the present invention can be applied to the case where the distal end portion of the shield shell is not divided and also to the case where the number of the sections is 3 or less, or 5 or more.

In the above embodiment, although each shield shell has a cylindrical tubular shape, the present invention can be applied to the case where the shield shell has other shape such as a square tubular shape.

What is claimed is:

1. A shield connector extending along an axis and having a female connector housing and a male connector housing that to releasably connect together, the male connector housing including a male-side fitting surface and a male metal terminal with a distal end portion projecting from the male-side fitting surface mounted in the male connector housing, the female connector housing including a female-side fitting surface, each of the male and female connector housings including a shield shell extending in an axial direction, the male-side fitting surface and the female-side fitting surface extending radial relative to the axis and forming a gap therebetween when the male and female connector housings are releasably connected together, the shield connector comprising:

a step portion formed on one of the male connector housing and the female connector housing and exposed to the distal end portion of the male metal terminal through the gap, a respective one of the shield shells extending through the step portion.

2. The shield connector according to claim 1, wherein the fitting surface of the one connector housing is disposed axially inwardly of the step portion.

3. The shield connector according to claim 1, further comprising a hood portion formed on a remaining one of the male connector housing and the female connector housing and projecting forwardly from an outer peripheral edge of the fitting surface of the remaining one of the male connector housing and the female connector housing, the step portion projecting inwardly from an inner periphery of the hood portion along the fitting surface.

4. A shield connector, comprising:

a female connector housing including an axially-extending retainer disposed within the female connector housing and having a radially-extending female-side fitting surface connected to and disposed forward of the retainer with a hole formed therethrough; and a male connector housing including a step portion, a radially-extending male-side fitting surface and a male metal terminal mounted in the male connector housing with a distal end portion projecting axially from the male-side fitting surface, the step portion disposed within the male connector housing and having a radially-extending inner peripheral surface intersecting the male-side fitting surface to define a receiving chamber, wherein the male and female connector housings releasably connect with each other such that the receiving chamber slidably and releasably receives a portion of the retainer in a close-fitting relationship while the distal end portion is inserted through the hole with the male-side fitting surface and the female-side fitting surface being positioned in facial registration with each other.

5. The shield connector according to claim 4, wherein the male connector housing further comprises a hood portion having an inner periphery surface that defines an axially extending hood chamber, the hood chamber being in communication with the receiving chamber to form the step portion.

* * * * *